US007731510B2

(12) United States Patent
Tada et al.

(10) Patent No.: US 7,731,510 B2
(45) Date of Patent: Jun. 8, 2010

(54) CONNECTOR DEVICE FOR INTERCONNECTING CIRCUIT SUBSTRATES

(75) Inventors: Morio Tada, Toyama (JP); Satoshi Ueno, Toyama (JP); Satoru Takasaki, Toyama (JP)

(73) Assignee: Hokuriku Electric Industry Co., Ltd., Toyama-shi (JP)

( * ) Notice: Subject to any disclaimer, the term of this patent is extended or adjusted under 35 U.S.C. 154(b) by 0 days.

(21) Appl. No.: 12/443,316

(22) PCT Filed: Aug. 29, 2007

(86) PCT No.: PCT/JP2007/066776

§ 371 (c)(1),
(2), (4) Date: Mar. 27, 2009

(87) PCT Pub. No.: WO2008/041433

PCT Pub. Date: Apr. 10, 2008

(65) Prior Publication Data

US 2009/0253275 A1 Oct. 8, 2009

(30) Foreign Application Priority Data

Sep. 29, 2006 (JP) ..... 2006-269652

(51) Int. Cl.
*H01R 4/58* (2006.01)

(52) U.S. Cl. ..... 439/91; 439/591; 439/86

(58) Field of Classification Search ..... 439/91, 439/591, 86

See application file for complete search history.

(56) References Cited

U.S. PATENT DOCUMENTS

| | | | | |
|---|---|---|---|---|
| 4,449,774 | A * | 5/1984 | Takashi et al. | 439/591 |
| 5,026,290 | A * | 6/1991 | Dery | 439/591 |
| 5,431,571 | A * | 7/1995 | Hanrahan et al. | 439/91 |
| 6,581,276 | B2 * | 6/2003 | Chung | 29/825 |
| 6,796,811 | B1 * | 9/2004 | Pupkiewicz et al. | 439/86 |
| 7,131,851 | B2 * | 11/2006 | Setaka et al. | 439/91 |
| 7,326,068 | B2 * | 2/2008 | Sturm et al. | 439/86 |
| 2002/0055283 | A1 | 5/2002 | Yoon et al. | |
| 2003/0232525 | A1 * | 12/2003 | Ward et al. | 439/91 |

FOREIGN PATENT DOCUMENTS

| | | |
|---|---|---|
| JP | 09-092365 | 4/1997 |
| JP | 2003-203688 | 7/2003 |
| JP | 2004-265599 | 9/2004 |
| JP | 2006-040744 | 2/2006 |

* cited by examiner

*Primary Examiner*—Briggitte R Hammond
(74) *Attorney, Agent, or Firm*—Rankin, Hill & Clark LLP

(57) ABSTRACT

A connector device for interconnecting circuit substrates is provided, in which no electric element for protection needs to be mounted separately on circuit substrates. A rectangular parallelepiped connecting element having an electrical component (9) is received in a connector housing (11). The rectangular parallelepiped connecting element having an electrical component (9) includes a plurality of first electrically conducting path portions (17*a*) and a plurality of second electrically conducting path portions (17*b*) disposed on a rectangular parallelepiped insulating base (13), and a plurality of electric elements (19) that are electrically connected in series with the plurality of first electrically conducting path portions (17*a*) and the plurality of second electrically conducting path portions (17*b*). The connector housing (11) is configured to allow the plurality of first electrically conducting path portions (17*a*) to be electrically connected to a plurality of first connecting electrodes (3) of a first circuit substrate (1), and bring a plurality of second connecting electrodes (7) on a second circuit substrate (5) into contact with the plurality of second electrically conducting path portions (17*b*).

19 Claims, 12 Drawing Sheets

CONNECTOR DEVICE FOR INTERCONNECTING CIRCUIT SUBSTRATES

TECHNICAL FIELD

The present invention relates to a connector device for interconnecting circuit substrates that is used for electrically connecting a plurality of first connecting electrodes disposed on a first circuit substrate and a plurality of second connecting electrodes disposed on a second circuit substrate, the plurality of first connecting electrodes being juxtaposed on a surface of the first circuit substrate at a given pitch for electrodes, the plurality of second connecting electrodes being juxtaposed on a surface of the second circuit substrate at a given pitch for electrodes.

BACKGROUND ART

In Japanese Patent Application Publication No. 2004-265599, FIG. 6 (Patent Document 1, JP2004-265599A), a conventional connector device for interconnecting circuit substrates is disclosed. In Japanese Patent Application Publication No. 2006-40744, FIG. 6 (Patent Document 2, JP2006-40744), a configuration is disclosed in which electric elements such as a resistor/capacitor for protection and ESC (electrostatic discharge) protection components are connected to a wiring portion on the side of a circuit substrate that is connected to the connector device. Typically, those electric elements for protection have been disposed on a circuit substrate in the past (with reference to Patent Document 2, for example).

DISCLOSURE OF THE INVENTION

Problems to be Solved by the Invention

However, if electric elements for protection are disposed on two circuit substrates to be interconnected using a connector device, a space for mounting the electric elements has to be secured on the surfaces of the circuit substrates, and mounted components increase in number. Since ESD protection components need to be disposed on each signal line, more space for mounting those components is required on the surfaces of circuit substrates.

An object of the present invention is to provide a connector device for interconnecting circuit substrates, wherein no electric element for protection needs to be separately mounted on circuit substrates.

Means of Solving the Problems

A connector device for interconnecting circuit substrates according to the present invention is used for electrically connecting a plurality of first connecting electrodes disposed on a first circuit substrate and a plurality of second connecting electrodes disposed on a second circuit substrate. The plurality of first connecting electrodes are juxtaposed on a surface of the first circuit substrate at a given first pitch for electrodes, and the plurality of second connecting electrodes are juxtaposed on a surface of the second circuit substrate at a given second pitch for electrodes.

In particular, the connector device for interconnecting circuit substrates according to the present invention includes a rectangular parallelepiped connecting element having an electrical component and a connector housing. A first type of rectangular parallelepiped connecting element having an electrical component is configured to connect a kind of electrical component between the first and second connecting electrodes. The rectangular parallelepiped connecting element having an electrical component includes a rectangular parallelepiped insulating base having four continuous faces and two opposed end faces. A plurality of first electrically conducting path portions are juxtaposed on one of two opposed faces in at least three continuous faces among the four continuous faces of the insulating base at a given insulating interval in a direction where the two opposed end faces are arranged. A plurality of second electrically conducting path portions are juxtaposed on the other one of the two opposed faces of the three continuous faces of the insulating base at a given insulating interval in the direction where the two opposed end faces are arranged. A plurality of electric elements are juxtaposed on one face located between the two opposed faces of the three continuous faces at a given insulating interval in the direction where the two opposed end faces are arranged. The plurality of electric elements are connected in series with the plurality of first electrically conducting path portions and the plurality of second electrically conducting path portions. A pitch for electrically conducting paths of the plurality of first electrically conducting path portions is substantially equal to the first pitch for electrodes, and a pitch for electrically conducting paths of the plurality of second electrically conducting path portions is substantially equal to the second pitch for electrodes.

The connector housing is configured to allow the plurality of first electrically conducting path portions of the rectangular parallelepiped connecting element having an electrical component to be electrically connected to the plurality of first connecting electrodes disposed on the first circuit substrate. The connector housing is also configured to receive a substrate portion of the second circuit substrate where the plurality of second connecting electrodes are disposed and hold the substrate portion in a position where the plurality of second electrically conducting path portions disposed on the rectangular parallelepiped connecting element having an electrical component are opposed to the plurality of second connecting electrodes. The connector housing is configured to also bring the plurality of second connecting electrodes into contact with the plurality of second electrically conducting path portions.

The connector device for interconnecting circuit substrates according to the present invention may electrically interconnect two circuit substrates by inserting one of the two circuit substrates into the connector housing. According to the present invention, since the connector device may be configured just by providing a rectangular parallelepiped connecting element having an electrical component in the connector housing without a plurality of contact components, the connector device may be constituted from just a few number of components. In particular, according to the present invention, since electric elements are disposed on the rectangular parallelepiped connecting element which is used for connecting two circuit substrates to each other, it becomes possible to connect an electric element for protection between connecting electrodes on the two circuit substrates to be interconnected, just by mounting the connector device for interconnecting circuit substrates on one of the two circuit substrates. As a result, the connector device for interconnecting circuit substrates according to the present invention has an advantage that there is no need to separately mount an electric element for protection on circuit substrates.

Preferably, a plurality of first electrode portions connected to the plurality of first electrically conducting path portions and a plurality of second electrode portions connected to the plurality of second electrically conducting path portions are formed on one face where the electric elements are formed. Here, the electric element is formed across the first electrode portion and the second electrode portion. Such configuration allows more secured electrical connection of the electric elements to the first and second electrically conducting path portions.

A second type of rectangular parallelepiped connecting element having an electrical component is configured to allow two electrical components connected in parallel to be connected in series between the first and second connecting electrodes. The rectangular parallelepiped connecting element having an electrical component includes a plurality of first electrically conducting path portions that are juxtaposed on one of two opposed faces among the four continuous faces of the insulating base at a given insulating interval in the direction where the two opposed end faces are arranged, and a plurality of second electrically conducting path portions that are juxtaposed on the other one of the two opposed faces among the four continuous faces at a given insulating interval in the a direction where the two opposed end faces are arranged. A first group of a plurality of electric elements are juxtaposed on one of two faces located between the two opposed faces of the four continuous faces at a given insulating interval in the direction where the two opposed end faces are arranged. A second group of a plurality of electric elements are juxtaposed on the other one of the two faces located between the two opposed faces among the four continuous faces at a given insulating interval in the direction where the two opposed end faces are arranged. The plurality of electric elements belonging to the first and second groups are electrically connected in series with the plurality of first electrically conducting path portions and with the plurality of second electrically conducting path portions respectively. According to the connector device for interconnecting circuit substrates using such second type of rectangular parallelepiped connecting element having an electrical component, it becomes possible to provide parallel circuits in which electric elements belonging to the first group and electric elements belonging to the second group are connected in parallel between the first connecting electrodes on the first circuit substrate and the second connecting electrodes on the second circuit substrate, without separately mounting a component other than the connector device on the circuit substrates. The first group of the plurality of electric elements and the second group of the plurality of electric elements may have the same or different electrical characteristics, and they may be elements of the same or different type. When elements having different electrical characteristics or of a different type are used, circuits such as RC/LC parallel circuits may be easily disposed within the connector device.

Preferably, a plurality of first electrode portions connected to the plurality of first electrically conducting path portions and a plurality of second electrode portions connected to the plurality of second electrically conducting path portions are formed on the one face of the insulating base where the first group of the plurality of electric elements are formed, and the first group of the electric elements are formed across the first electrode portions and the second electrode portions. Preferably, a plurality of third electrode portions connected to the plurality of first electrically conducting path portions and a plurality of fourth electrode portions connected to the plurality of second electrically conducting path portions are formed on the other face where the second group of the plurality of electric elements are formed, and the second group of the electric elements are formed across the third electrode portions and the fourth electrode portions.

Whether the first or the second type of rectangular parallelepiped connecting element having an electrical component is received in the connector housing of the connector device, the pitch for electrically conducting paths of the plurality of first electrically conducting path portions may be equal to that of the plurality of second electrically conducting path portions, and the plurality of first electrically conducting path portions and the plurality of second electrically conducting path portions are disposed alternately in the direction where the two end faces are arranged. In this configuration, the dimension of electric elements formed between the first and second electrically conducting path portions may be determined arbitrarily by determining an appropriate distance between the first and the second electrically conducting path portions.

If the pitch for electrically conducting paths of the plurality of first electrically conducting path portions is different from that of the second electrically conducting path portions, electrical connection may be made between the first and second circuit substrates having a different pitch for electrodes, by conforming the pitch for electrodes of the plurality of first connecting electrodes on the first circuit substrate to the pitch for electrically conducting paths of the plurality of first electrically conducting path portions, and by conforming the pitch for electrodes of the plurality of second connecting electrodes on the second circuit substrate to the pitch for electrically conducting paths of the plurality of second electrically conducting path portions.

The connector device for interconnecting circuit substrates according to the present invention may have an ESD (electrostatic discharge) protection component built therein as described below. A plurality of first connecting electrodes are juxtaposed alternately at first and second pitches for electrodes on a surface of a first circuit substrate that is to be connected using the connector device for interconnecting circuit substrates that has a built-in ESD (electrostatic discharge) protection component is built in. A plurality of second connecting electrodes are juxtaposed alternately at the first and second pitches for electrodes, and a plurality of third connecting electrodes are juxtaposed at a third pitch for electrodes between the second connecting electrodes disposed at the first pitch for electrodes on a surface of a second circuit substrate. The connector device for interconnecting circuit substrates electrically connects a plurality of first connecting electrodes disposed on a first circuit substrate and a plurality of second connecting electrodes disposed on a second circuit substrate.

Such connector device for interconnecting circuit substrates employs a third or fourth type of rectangular parallelepiped connecting element having an electrical component and a connector housing. The third type of rectangular parallelepiped connecting element having an electrical component includes a rectangular parallelepiped insulating base having four continuous faces and two opposed end faces. A plurality of first electrically conducting paths are juxtaposed on at least three continuous faces of the four continuous faces of the insulating base in a direction where the two end faces are arranged at given insulating intervals so that the first pitch for electrically conducting paths equal to the first pitch for electrodes and the second pitch for electrically conducting paths equal to the second pitch for electrodes may alternately appear. A plurality of second electrically conducting paths are juxtaposed at a given insulating interval on two continuous faces of the three continuous faces of the insulating base in the direction where the two end faces are arranged, and each second conducting path is disposed at a third pitch for electrically conducting paths equal to the third pitch for electrodes between two of the first electrically conducting paths disposed at the first pitch for electrically conducting paths. The insulating base further includes a plurality of electric elements made of an ESD absorbing element material, which are disposed on one face located between two opposed faces of the three continuous faces. The electric elements are disposed across two first electrically conducting path portions, included in the two first electrically conducting path disposed at the first pitch for electrically conducting paths and a second electrically conducting path portion, included in the second electrically conducting path, located between the two first electrically conducting path portions.

In this configuration, the second electrically conducting path portions are grounded, and electrostatic discharge is generated between the first electrically conducting path portion and the second electrically conducting path portion. Characteristics of the ESD absorbing element material disposed between the first and second electrically conducting path portions may be determined arbitrarily according to the required characteristics of discharge. In the fourth type of rectangular parallelepiped connecting element having an electrical component, no electric element constituted from an ESD absorbing element material is provided, and the first electrically conducting path portions and the second electrically conducting path portions are disposed to face each other with a gap provided therebetween for discharge. Such configuration also allows electrostatic discharge to be generated between the first and second electrically conducting path portions.

Either type of the rectangular parallelepiped connecting element having an electrical component is configured so that the pitches for electrically conducting paths of the plurality of first electrically conducting paths may be substantially equal to the first and second pitches for electrodes, and the pitch for electrically conducting paths of the plurality of second electrically conducting paths may be substantially equal to the pitch for the third electrodes.

When the connector housing is mounted to the first circuit substrate, the connector housing is mounted onto the first circuit substrate with the rectangular parallelepiped connecting element being received therein. The connector housing is configured to allow the plurality of first electrically conducting path portions disposed on one of the two opposed faces of the three continuous faces of the rectangular parallelepiped connecting element having an electrical component to be electrically connected to the plurality of first connecting electrodes disposed on the first circuit substrate. The connector housing is configured to also receive a substrate portion of the second circuit substrate where the plurality of second connecting electrodes are disposed and hold the substrate portion in a position where the plurality of first electrically conducting path portions disposed on the other one of the two opposed faces of the three continuous faces of the rectangular parallelepiped connecting element having an electrical component are opposed to the plurality of second connecting electrodes disposed on the second circuit substrate, and the plurality of second electrically conducting path portions disposed on the other face are opposed to the plurality of third connecting electrodes disposed on the second circuit substrate. The connector housing is further configured to bring the plurality of second connecting electrodes into contact with the first electrically conducting path portions and bring the plurality of third connecting electrodes into contact with the second electrically conducting path portions. In this configuration, the third connecting electrodes are grounded.

When the connector housing is mounted onto the second circuit substrate, the connector housing is configured to allow the plurality of first electrically conducting path portions disposed on one of the two opposed faces of the three continuous faces of the rectangular parallelepiped connecting element to be electrically connected to the plurality of second connecting electrodes disposed on the second circuit substrate and also allow the plurality of second conducting path portions to be electrically connected to the plurality of third connecting electrodes disposed on the second circuit substrate. The connector housing is also configured to receive a substrate portion of the first circuit substrate where the plurality of first connecting electrodes are disposed, and hold the substrate portion in a position where the plurality of first electrically conducting path portions disposed on the other one of the two opposed faces of the three continuous faces of the rectangular parallelepiped connecting element are opposed to the plurality of first connecting electrodes disposed on the first circuit substrate. The connector housing is further configured to bring the plurality of first connecting electrodes into contact with the plurality of first electrically conducting path portions. In this configuration, too, the third connecting electrodes are grounded.

The connector housing comprises a housing body and a pushing means. The housing body includes a first receiving chamber which receives the connecting element with the one face of the connecting element exposed, a second receiving chamber that communicates with the first receiving chamber and receives the substrate portion, and an inserting opening through which the substrate portion is inserted into the second receiving chamber from outside. The pushing means is received in the second receiving chamber and pushes the substrate portion against the connecting element. With such configuration, positioning of the connecting element with respect to one of the two circuit substrates, positioning of the connecting element with respect to the other of the two circuit substrates, and positioning of the pushing means that pushes the substrate portion against the connecting element may be determined easily by means of the connector housing. The pushing means may be configured to push the substrate portion against the connecting element by means of spring force or elastic force. With such pushing means, a force to push the substrate portion against the connecting element may readily be obtained.

BEST MODE FOR CARRYING OUT THE INVENTION

Figure 1A:
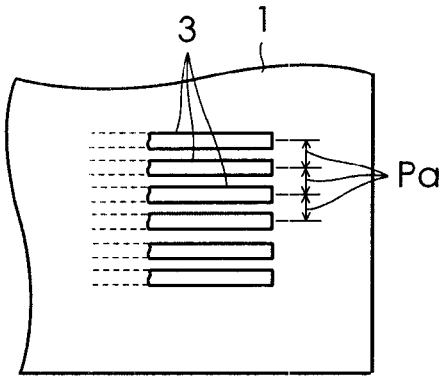
FIGS. 1A and 2A are partial plan view of first and second circuit substrates to be connected to each other using a connector device for interconnecting circuit substrates according to a first embodiment of the present invention.
Figure 2A:
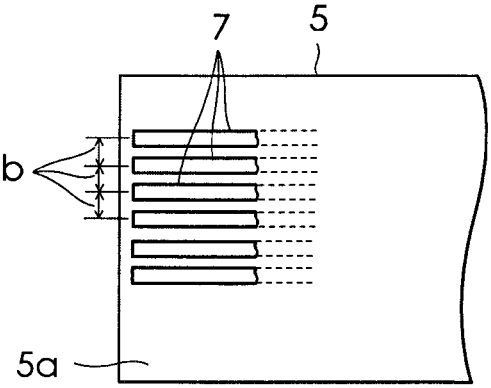
Figure 2:
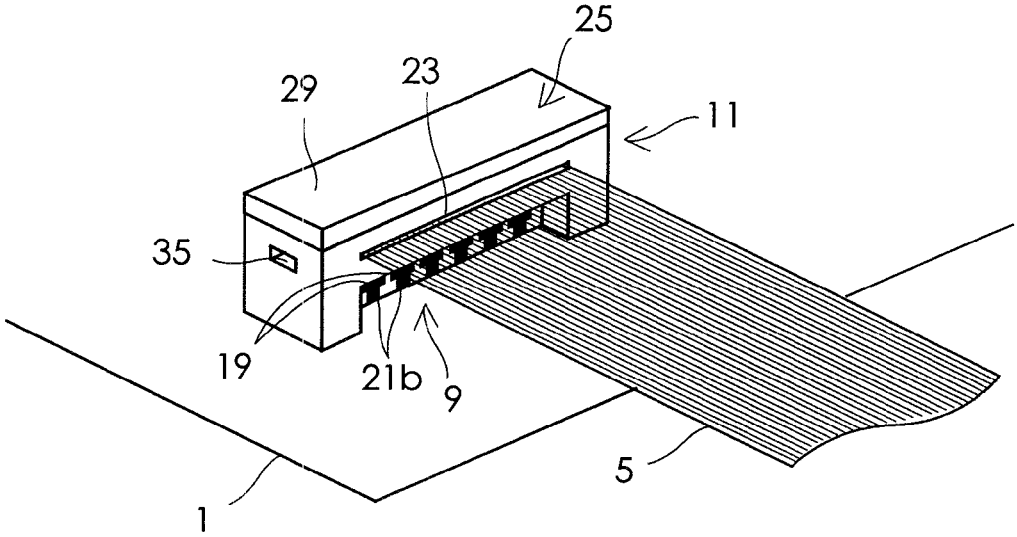
FIG. 2 is a perspective view of the connector device for interconnecting circuit substrates of the first embodiment.
Figure 3A:
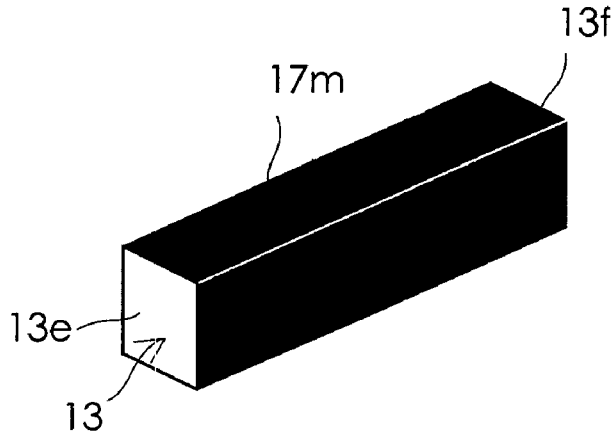
FIGS. 3A to 3D are perspective views showing a manufacturing process of a first type of rectangular parallelepiped connecting element having an electrical component used in the connector device for interconnecting circuit substrates of the first embodiment.
Figure 3B:
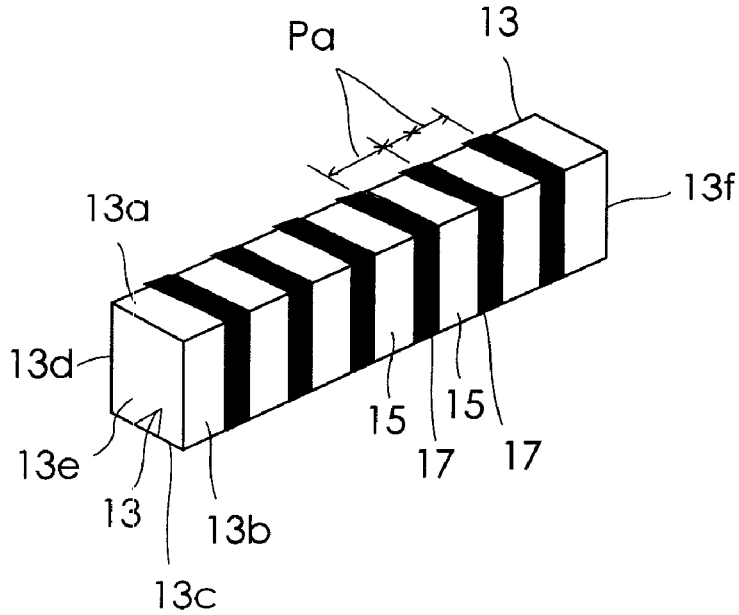
Figure 3C:
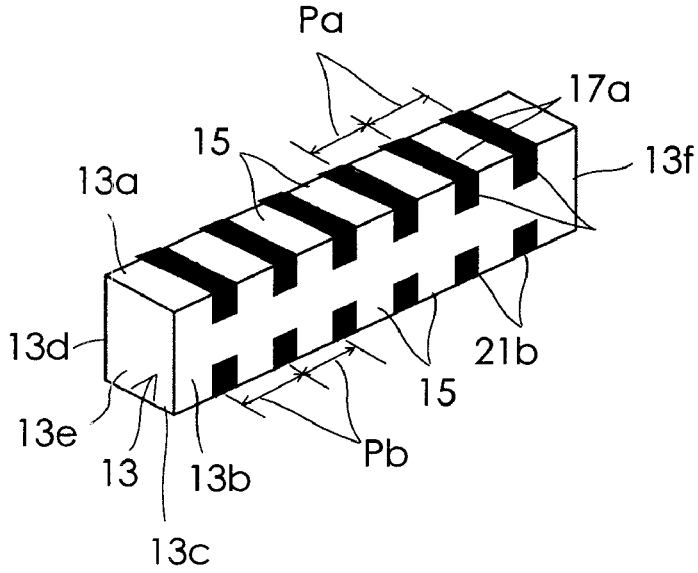

Hereinafter, the best mode for carrying out the present invention will be described in detail with reference to the drawings. FIGS. 1 to 5 are views describing a connector device for interconnecting circuit substrates according to a first embodiment of the present invention. FIGS. 1A and 1B are partial plan view of first and second circuit substrates to be connected to each other using the connector device for interconnecting circuit substrates according to the present embodiment. FIG. 2 is a perspective view of the connector device for interconnecting circuit substrates according to the present embodiment. FIGS. 3A to 3D are perspective views showing a manufacturing process of a rectangular parallelepiped connecting element having an electrical component that is used in the connector device for interconnecting circuit substrates according to the present embodiment, and FIG. 3E is a sectional view taken along line A-A of FIG. 3D. FIG. 4A is a perspective view of the connector device for interconnecting circuit substrates of the first embodiment, showing that the rectangular parallelepiped connecting element is received in a connector housing thereof. FIG. 4B is a perspective view of a contact structure that is fitted into an opening portion of the connector housing shown in FIG. 4A. FIG. 5 is a vertical sectional view of the connector housing used in the connector device for interconnecting circuit substrates of the first embodiment with the rectangular parallelepiped connecting element having an electrical component received therein.

The connector device for interconnecting circuit substrates according to the present embodiment is, as shown in FIG. 1, used for electrically connecting a plurality of first connecting electrodes 3 of a first circuit substrate 1 and a plurality of second connecting electrodes 7 of a second circuit substrate 2. The first circuit substrate 1 includes a plurality of first connecting electrodes 3 that are juxtaposed on a surface thereof at a first pitch Pa for electrodes. The second circuit substrate 5 includes a plurality of second connecting electrodes 7 that are juxtaposed on a surface thereof at a given second pith Pb for electrodes. The first and second pitches for electrodes, Pa and Pb may be set to an arbitrary value. For example, the first and second pitches for electrodes, Pa and Pb may be set to 0.2 mm or less. In the present embodiment, the first pitch Pa for electrodes of the first connecting electrodes 3 juxtaposed on the first circuit substrate 1 is equal to the second pitch Pb for electrodes of the second connecting electrodes 7 juxtaposed on the second circuit substrate 5. The second circuit substrate 5 in the present embodiment is a flexible one having a narrow width.

Figure 3D:
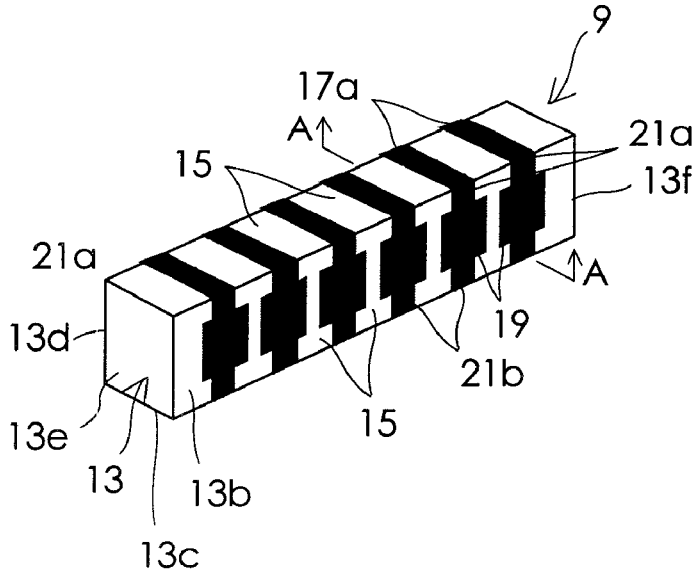
Figure 3E:
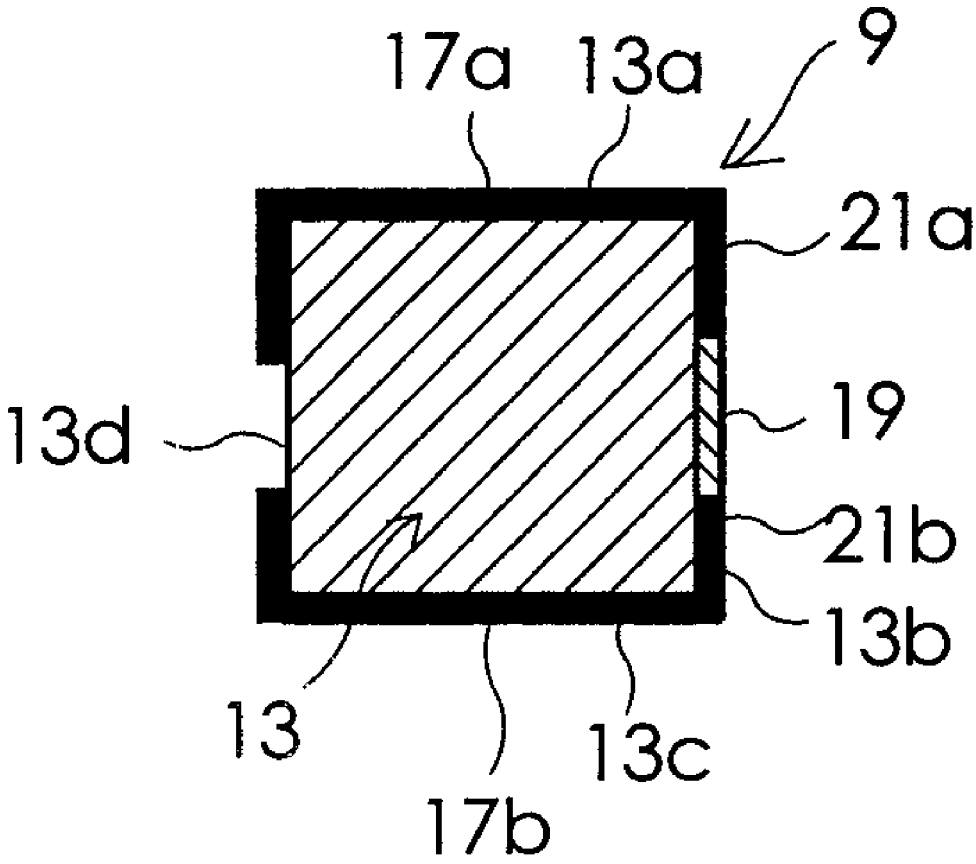
FIG. 3E is a sectional view taken along line A-A of FIG. 3D.
Figure 4A:
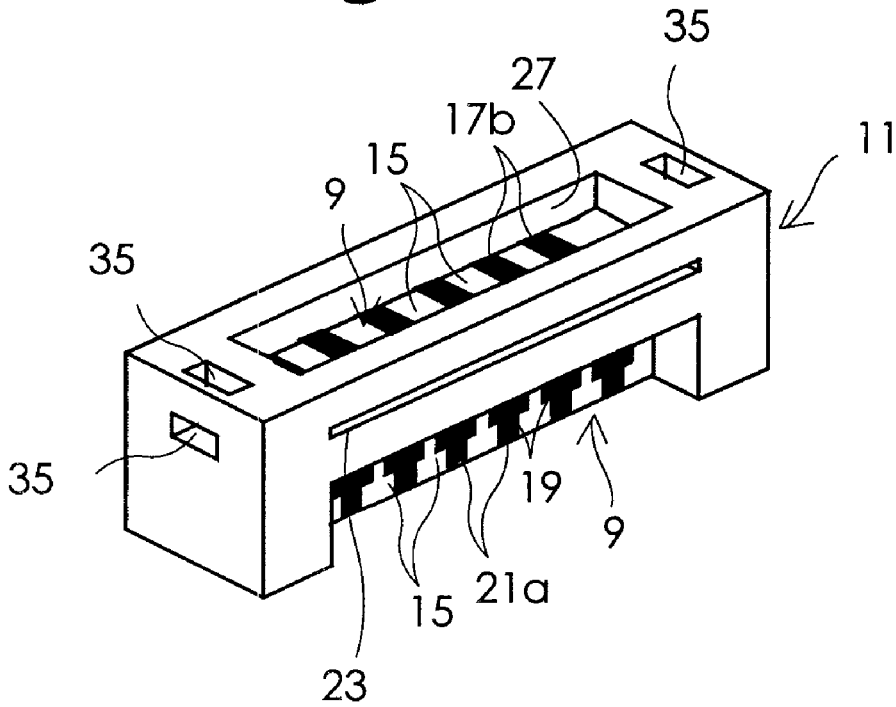
FIG. 4A is a perspective view of the connector device for interconnecting circuit substrates of the first embodiment, showing that the first type of rectangular parallelepiped connecting element is received in a connector housing thereof.
Figure 4B:
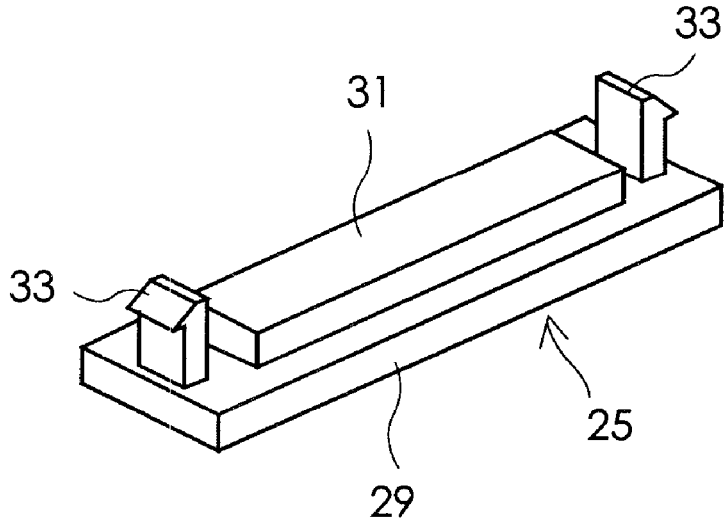
FIG. 4B is a perspective view of a contact structure that is fitted into an opening portion of the connector housing shown in FIG. 4A.
Figure 5:
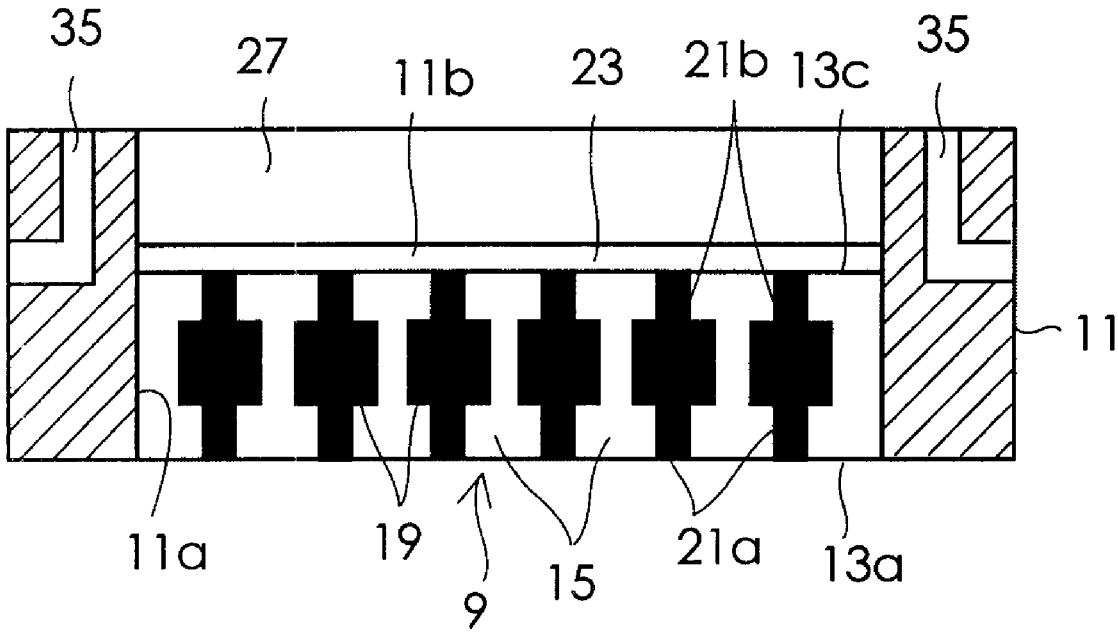
FIG. 5 is a vertical sectional view of the connector housing used in the connector device for interconnecting circuit substrates of the first embodiment with the first type of rectangular parallelepiped connecting element having an electrical component received therein.

The connector device for interconnecting circuit substrates according to the present embodiment employs a rectangular parallelepiped connecting element 9 having an electrical component (first type) as shown in FIG. 3D and the connector housing 11 as shown in FIGS. 2 and 4A.

The first type of rectangular parallelepiped connecting element 9 having an electrical component 9 includes a rectangular parallelepiped ceramic insulating base 13 as shown in FIGS. 3A to 3E. The insulating base 13 includes four continuous faces 13*a* to 13*d* and two opposed end faces 13*e* and 13*f*. The connecting element 9 includes a plurality of first electrically conducting path portions 17*a* that are juxtaposed on one face 13*a* of two opposed faces 13*a* and 13*c* in at least three continuous faces 13*a* to 13*c* among the four continuous faces 13*a* to 13*d* at a given insulating interval 15 in a direction where the two end faces 13*e* and 13*f* are arranged. The connecting element 9 also includes a plurality of second electrically conducting path portions 17*b* that are juxtaposed on the other face 13*c* of the two opposed faces 13*a* and 13*c* of the continuous three faces 13*a* to 13*c* at the given insulating interval 15 in the direction where the two end faces 13*e* and 13*f* are arranged. The connecting element 9 further includes a plurality of electric elements 19 that are juxtaposed on the face 13*b* located between the two opposed faces 13*a* and 13*c* of the three continuous faces 13*a* to 13*c* at the given insulating interval 15 in the direction where the two end faces 13*e* and 13*f* are arranged. Examples of the electric elements 19 used here include a resistor and a capacitor. The plurality of electric elements 19 are electrically connected in series with the plurality of first electrically conducting path portions 17*a* and 17*b*. In the present embodiment, a plurality of first electrode portions 21*a* that are connected to the plurality of first electrically conducting path portions 17*a* and a plurality of second electrode portions 21*b* that are connected to the plurality of second electrically conducting path portions 17*b* are disposed on the face 13*b* where the electric elements 19 are formed, and the electric elements 19 are formed across the first and second electrode portions 21*a* and 21*b*. To simplify the illustration, a figure of how the electric elements 19 are formed across the first and second electrode portions; 21*a* and 21*b* is omitted. In the present embodiment, a pitch Pa for electrically conducting paths of the plurality of first electrically conducting path portions 17*a* is substantially equal to the first pitch Pa for electrodes, and a pitch Pb for electrically conducting paths of the plurality of second conducting path portions 17*b* is substantially equal to the second pitch Pb for electrodes.

Such rectangular parallelepiped connecting element having an electrical component 9 may be manufactured as described below, for example. As shown in FIG. 3A, a conductive portion 17*m* made of a highly conductive material such as Au, Ag, Cu, Cu—Ni alloy, and Au—Ag alloy is formed to cover all over the four continuous faces 13*a* to 13*d* of the insulating base 13 by means of printing, plating, sputtering or the like. Then, the conductive portion 17*m* is partially removed with laser etc. in a circumferential direction to obtain the given insulating intervals 15 in the direction where the two end faces 13*e* and 13*f* are arranged. In this manner, the plurality of electrically conducting paths 17 are formed, as shown in FIG. 3B. For example, each insulating interval 15 is formed to be 20 μm in width, and the electrically conducting path 17 is formed to be 80 μm in width with laser etc. These steps are repeated at 0.1 mm pitch. The configuration shown in FIG. 3B is thus completed. Next, as shown in FIG. 3C, a part of the electrically conducting path 17 disposed on one face 13*d* of the insulating base 13 is removed with laser, etc. so that the plurality of electrically conducting paths 17 may remain on the three continuous faces 13*a* to 13*c* of the insulating base 13. Subsequently, a central portion of the electrically conducting paths 17 disposed on the face 13*b* located in the center of the three continuous faces 13*a* to 13*c* of the insulating base 13 is removed with laser, etc. As a result, the plurality of first electrically conducting path portions 17*a* are juxtaposed on the face 13*a* of the insulating base 13 at the given insulating interval 15 in the direction where the two end faces 13*e* and 13*f* are arranged. The plurality of second electrically conducting path portions 17*b* are juxtaposed on the face 13*c* that faces the face 13*a* of the insulating base 13 at the given insulating interval 15 in the direction where the two end faces 13*e* and 13*f* are arranged. The plurality of first electrode portions 21*a* connected to the plurality of first electrically conducting path portions 17*a*, and the plurality of second electrode portions 21*b* connected to the plurality of second electrically conducting path portions 17*b* are formed on the face 13*b* that is located in the center of the three continuous faces 13*a* to 13*c* of the insulating base 13. Then, the plurality of electric elements 19 are formed between the plurality of first and second electrode portions 21*a* and 21*b* that are formed on the face 13*b* located in the center of the three continuous faces 13*a* to 13*c* of the insulating base 13, and the electric elements 19 are connected to the first and second electrode portions, 21*a* and 21*b* as shown in FIG. 3D. In this manner, the rectangular parallelepiped connecting element having an electrical component 9 is thus completed. A pitch below 0.1 mm is also available by forming the electrically conducting paths 17 to be less than 80 μm in width.

The connector housing 11 is made of a liquid crystal polymer and includes a first receiving chamber 11*a* that receives the rectangular parallelepiped connecting element having an electrical component 9 with one face 13*a* thereof exposed, a second receiving chamber 11*b* that communicates with the first receiving chamber 11*a* and receives a substrate portion 5*a* of the second circuit substrate 5 where the plurality of second connecting electrodes are disposed, and an inserting opening 23 that inserts the substrate portion 5*a* into the second receiving chamber 11*b* from outside, as shown in FIG. 5.

As shown in FIGS. 2 and 4A, the connector housing 11 is mounted to the first circuit substrate 1, with the rectangular parallelepiped connecting element having an electrical component 9 received in the first receiving chamber 11*a* with its position determined by the chamber. The connector housing 11 is mounted to the first circuit substrate 1, being glued with an adhesive on the bottom of the four corners of the connector housing 11, or by providing a protruding hook on the four corners of the connector housing 11, letting those hooks pass through four through-holes provided on the first circuit substrate 1 and fixedly engaged on the rear face thereof, and so on. When the connector housing 11 is mounted to the circuit substrate 1, the plurality of first electrically conducting path portions 17*a* of the rectangular parallelepiped connecting element having an electrical component 9 received in the connector housing 11 are aligned with the plurality of first connecting electrodes 3 on the first circuit substrate 1 and pushed into contact with them, or the plurality of first electrically conducting path portions 17*a* of the rectangular parallelepiped connecting element having an electrical component 9 are aligned and glued to the plurality of first connecting electrodes 3 on the first circuit substrate 1 with an electrically conductive adhesive.

The connector housing 11 is configured to allow the plurality of first electrically conducting path portions 17*a* disposed on one face 13*a* of two opposed faces 13*a* and 13*c* of the three continuous faces 13*a* to 13*c* of the received rectangular parallelepiped connecting element having an electrical component 9 to be electrically connected to the plurality of first connecting electrodes 3 that are disposed on the first circuit substrate 1. Further, the connector housing 11 is configured to receive the substrate portion 5*a* of the second circuit substrate 5 where the plurality of second connecting electrodes 7 are disposed, through the inserting opening 23 provided in the connector housing 11 and hold the substrate portion 5*a* in a position where the plurality of second electrically conducting path portions 17*b* disposed on the other face 13*c* of the two opposed faces 13*a* and 13*c* of the three continuous faces 13*a* to 13*c* of the rectangular parallelepiped connecting element having an electrical component 9 are opposed to the plurality of second connecting electrodes 7 disposed on the second circuit substrate 5. The longitudinal dimension of the inserting opening 23 is equal to the width of the second circuit substrate 5 so that the second circuit substrate 5 may be positioned within the connector housing 11. The connector housing 11 further includes a contact structure 25, which brings the plurality of second connecting electrodes 7 disposed on the second circuit substrate 5 into contact with the plurality of electrically conducting path portions 17*b* disposed on the other face 13*c* of the two opposed faces 13*a* and 13*c*. The contact structure 25 includes a cover member 29 and an elastic pushing member 31. The cover member 29 fixedly covers an opening portion 27 located in an upper portion of the connector housing 11, and the elastic pushing member 31 is made of a rubber plate or the like and fixedly glued on the back face of the cover member 29 for elastically pushing the substrate portion 5*a* of the second circuit substrate 5 that is inserted into the opening portion 27 of the connector housing 11. The cover member 29 is fixed to the connector housing 11 by elastically fitting a pair of hooks 33 disposed on the back face and at both ends, in the longitudinal direction, of the cover member 29 into a pair of hook holes 35 that are provided on the upper face and at both ends, in the longitudinal direction, of the connector housing 11.

In the connector device for interconnecting circuit substrates configured in this manner, the connector housing 11 that receives the rectangular parallelepiped connecting element having an electrical component 9 therein is fixed to the first circuit substrate 1 with the plurality of first electrically conducting path portions 17*a* of the rectangular connecting element having an electrical component 9 being connected to the plurality of first connecting electrodes 3 of the first circuit substrate 1. In such a state, the substrate portion 5*a* of the second circuit substrate 5 is inserted into the inserting opening 23 of the connector housing 11 where the opening portion 27 is open upward with the plurality of second electrically conducting path portions 17*b* facing downward. Since positioning of the rectangular parallelepiped connecting element having electrical component 9 is determined by the connector housing 11, and positioning of the substrate portion 5*a* of the second circuit substrate 5 is determined by the inserting opening 23 of the connector housing 11, the plurality of second connecting electrodes 7 of the second circuit substrate 5 are aligned and overlapped with the plurality of second electrically conducting path portions 17*b* of the rectangular parallelepiped connecting element having an electrical component 9. Then, the cover member 29 of the contact structure 25 fixedly covers the opening portion 27 of the connector housing 11 so that the substrate portion 5*a* of the second circuit substrate 5 may be pushed closely onto the rectangular parallelepiped connecting element having an electrical component 9 with the elastic pushing member 31 that is typically constituted from a rubber plate and provided on the back side of the cover member 29. In this manner, electrical connection of the plurality of second connecting electrodes 7 of the second circuit substrate 5 to the plurality of second electrically conducting path portions 17*b* of the rectangular parallelepiped connecting element having an electrical component 9 may be stabilized.

Figure 6A:
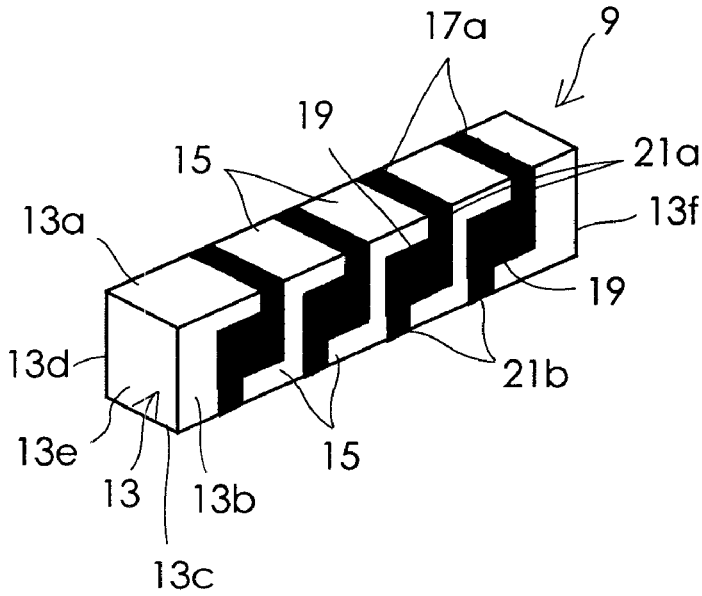
FIG. 6A is a perspective view of a rectangular parallelepiped connecting element (modified example of the first type) having an electrical component that is used in a connector device for interconnecting circuit substrates according to a second embodiment of the present invention.
Figure 6B:
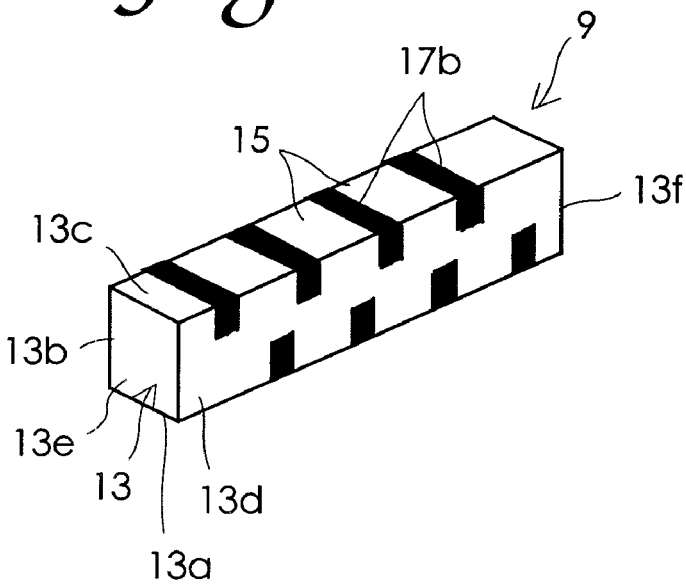
FIG. 6B shows that the perspective view of FIG. 6A is rotated 180 degrees about the longitudinal axis thereof.

FIG. 6A is a perspective view of a rectangular parallelepiped connecting element having an electrical component that is used in a connector device for interconnecting circuit substrates according to a second embodiment of the present invention. FIG. 6B shows that the perspective view of FIG. 6A is rotated 180 degrees about the longitudinal axis thereof. In the second embodiment (FIG. 6) portions similar to those of the first embodiment (FIGS. 1 to 5) have their reference numerals same as the corresponding reference numerals used in the first embodiment (FIGS. 2 to 5), and their descriptions will partially be omitted. The rectangular parallelepiped connecting element having electrical component 9 of FIG. 6 is a modified example of the first embodiment of rectangular parallelepiped connecting element having an electrical component 9 (first type). A plurality of first electrically conducting path portions 17*a* disposed on the face 13*a* of the insulating base 13 and a plurality of second electrically conducting path portions 17*b* disposed on the face 13*c* thereof opposed to the face 13*a* are zigzag arranged or staggered in a direction where the two end faces 13*e* and 13*f* are arranged. A plurality of electric elements 19 such as a resistor and capacitor are disposed between the plurality of first and second electrode portions 21*a* and 21*b*, and are electrically connected to the first electrode portions 21*a* and second electrode portions 21*b*.

Such connector device for interconnecting circuit substrates using the rectangular parallelepiped connecting element 9 having an electrical component (a modified example of the first type) may also obtain the same effects as that of the first embodiment.

Figure 7A:
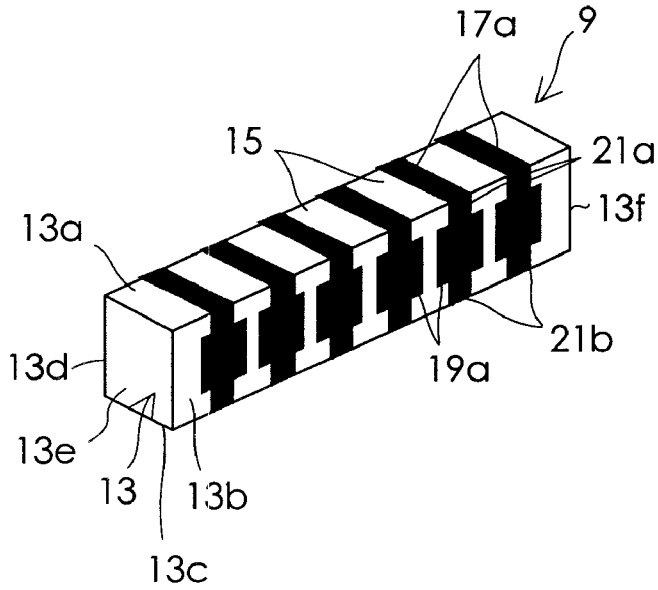
FIGS. 7A and 7B are perspective views of a second type of rectangular parallelepiped connecting element having an electrical component that is used in a connector device for interconnecting circuit substrates according to a third embodiment of the present invention, as viewed from a front side and a rear side respectively.
Figure 7B:
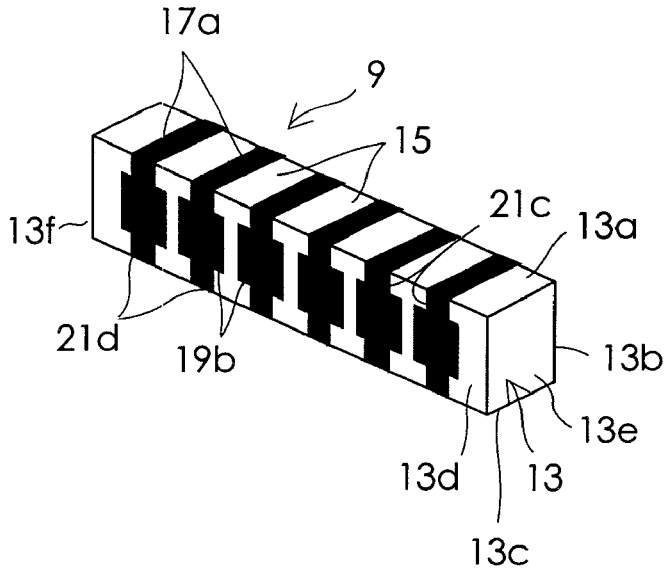

FIGS. 7A and 7B are perspective views of a rectangular parallelepiped connecting element having an electrical component that is used in a connector device for interconnecting circuit substrates according to a third embodiment of the present invention, as viewed from a front side and a rear side respectively. Also in the third embodiment (FIG. 7), portions similar to those of the first embodiment (FIGS. 2 to 5) have their reference numerals same as the corresponding reference numerals used in the first embodiment (FIGS. 2 to 5), and their descriptions will partially be omitted. In the third embodiment, a second type of rectangular parallelepiped connecting element having an electrical component 9 (the second type of rectangular parallelepiped connecting element having an electrical component) is used. The rectangular parallelepiped connecting element having an electrical component 9 (second type) allows two electrical components connected in parallel to be connected in series between the first connecting electrodes 3 on the first circuit substrate 1 and the second connecting electrodes 7 on the second circuit substrate 5 shown in FIG. 1. The rectangular parallelepiped connecting element includes a plurality of first electrically conducting path portions 17*a* that are juxtaposed on one face 13*a* of two opposed faces 13*a* and 13*c* among four continuous faces 13*a* to 13*d* of the insulating base 13 at a given insulating interval 15 in a direction where two opposed end faces 13*e* and 13*f* are arranged, and a plurality of second electrically conducting path portions 17*b* that are juxtaposed on the other face 13*c* of the two opposed faces 13*a* and 13*c* among the four continuous faces 13*a* to 13*d* at a given insulating interval 15 in the direction where the two opposed end faces 13*e* and 13*f* are arranged. A first group of a plurality of electric elements 19*a* such as a resistor and capacitor are juxtaposed on one face 13*b* of the two faces 13*b* and 13*d* that is located between the two opposed faces 13*a* and 13*c* of the four continuous faces 13*a* to 13*d* of the insulating base 13 at the given insulating interval 15 in the direction where the two end faces 13*e* and 13*f* are arranged. A second group of a plurality of electric elements 19*b* such as a resistor and capacitor are juxtaposed on the other face 13*d* of the two faces 13*b* and 13*d* that is located between the two opposed faces 13*a* and 13*c* of the four continuous faces 13*a* to 13*d* of the insulating base 13 at the given insulating interval 15 in the direction where the two end faces 13*e* and 13*f* are arranged. The first and second groups of electric elements 19*a* and 19*b* are electrically connected to the plurality of first and second electrically conducting path portions 17*a* and 17*b*. Specifically, a plurality of first electrode portions 21*a* connected to the plurality of first electrically conducting path portions 17*a* and a plurality of second electrode portions 21*b* connected to the plurality of second electrically conducting path portions 17*b* are formed on the face 13*b* of the insulating base 13 where the first group of the plurality of electric elements 19*a* are formed The first group of the electric elements 19*a* are formed across the first and second electrode portions 21*a* and 21*b*. A plurality of third electrode portions 21*c* connected to the plurality of first electrically conducting path portions 17*a*, and a plurality of fourth electrode portions 21*d* connected to the plurality of second electrically conducting path portions 17*b* are formed on the face 13*d* where the second group of plurality of electric elements 19*b* are formed. The second group of electric elements 19*b* are formed across the third and fourth electrode portions 21*c* and 21*d*. With such connector device for interconnecting circuit substrates that is used in the second type of rectangular parallelepiped connecting element having an electrical component as used in the present embodiment, a parallel circuit in which the first group of electric elements 19*a* and the second group of electric elements 19*b* are connected in parallel may be disposed between the first connecting electrodes 3 of the first circuit substrate 1 and the second connecting electrodes 7 of the second circuit substrate 5 shown in FIG. 1, without separately mounting a component other than the connector device on the circuit substrates. The first group of plurality of electric elements 19*a* and the second group of plurality of electric elements 19*b* may have the same or different electrical characteristics, and they may be of the same or different type of element. When elements having different electrical characteristics or of a different type are used, circuits such as RC/LC parallel circuits may easily be disposed within the connector device.

Figure 8A:
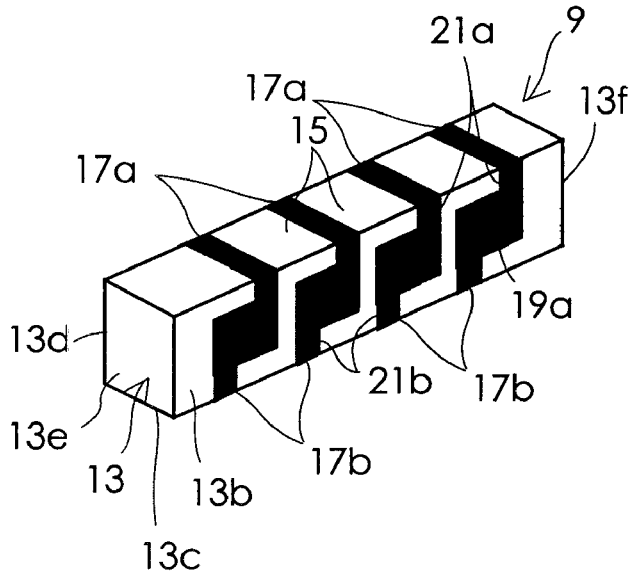
FIGS. 8A and 8B are perspective views of a rectangular parallelepiped connecting element (modified example of the second type) having an electrical component that is used in a connector device for interconnecting circuit substrates according to a fourth embodiment of the present invention, as viewed from a front side and a rear side respectively.
Figure 8B:
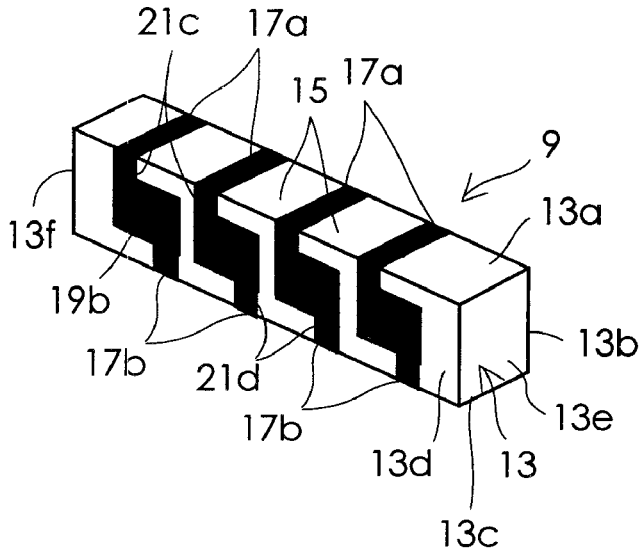

FIGS. 8A and 8B are perspective views of a rectangular parallelepiped connecting element having an electrical component that is used in a connector device for interconnecting circuit substrates according to a fourth embodiment of the present invention, as viewed from a front side and a rear side respectively. FIGS. 8A and 8B show a modified example of the second type of rectangular parallelepiped connecting element having an electrical component 9 as shown in FIGS. 7A and 7B. In the fourth embodiment (FIG. 8), portions similar to those of the first to third embodiments (FIGS. 2 to 7) have their reference numerals same as the corresponding reference numerals used in the first to third embodiments (FIGS. 2 to 7), and their descriptions will partially be omitted. In the rectangular parallelepiped connecting element having an electrical component 9 (a modified example of the second type) shown in FIG. 8, a pitch for electrically conducting paths of a plurality of first electrically conducting path portions 17*a* is equal to that of a plurality of second electrically conducting path portions 17*b*, and the plurality of first electrically conducting path portions 17*a* and the plurality of second electrically conducting path portions 17*b* are disposed zigzag arranged or staggered in the direction where the two end faces 13*e* and 13*f* of the insulating base 13 are arranged. Accordingly, the first electrode portions 21*a* and the second electrode portions 21*b* are zigzag arranged or staggered in the direction where the two end faces 13*e* and 13*f* are arranged, and the first group of electric elements 19*a* are formed across the first and second electrode portions 21*a* and 21*b* juxtaposed in the direction where the two end faces 13*e* and 13*f* are arranged. Similarly, the third electrode portions 21*c* and the fourth electrode portions 21*d* are zigzag arranged or staggered in the direction where two end faces 13*e* and 13*f* are arranged, and the second group of electric elements 19*b* are formed across the third and fourth electrode portions 21*c* and 21*d* juxtaposed in the direction where the two end faces 13*e* and 13*f* are arranged. Other configuration is the same as that of the embodiment shown in FIG. 7, the second type of rectangular parallelepiped connecting element having an electrical component).

Figure 9A:
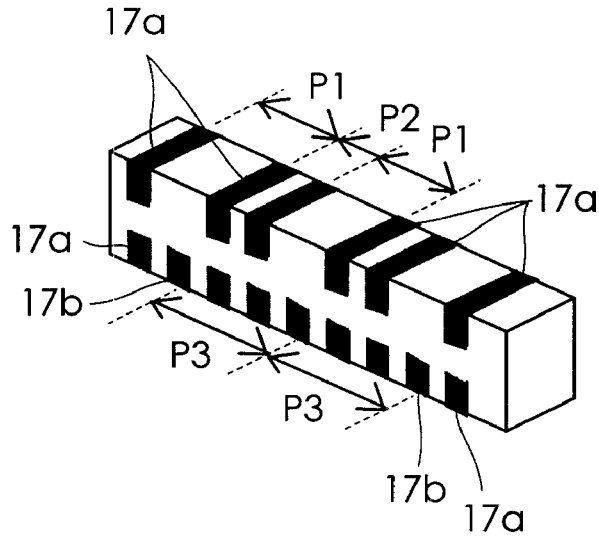
FIGS. 9A and 9B are perspective views of a third type of rectangular parallelepiped connecting element having an electrical component that is used in a connector device for interconnecting circuit substrates according to a fifth embodiment of the present invention in which an ESD (electrostatic discharge) protection component is built in, as viewed from a front side and a rear side respectively.
Figure 9B:
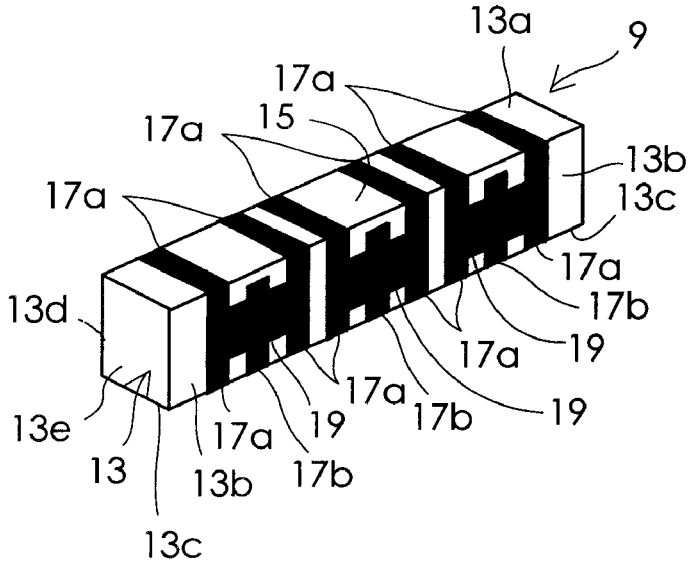
Figure 10A:
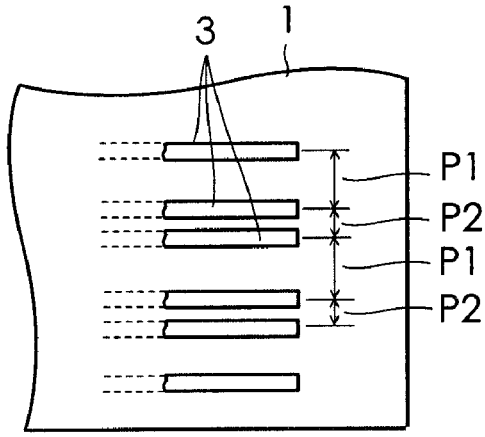
FIGS. 10A and 10B are partial plan views of first and second circuit substrates to be connected to each other using the connector device for interconnecting circuit substrates of the fifth embodiment.
Figure 10B:
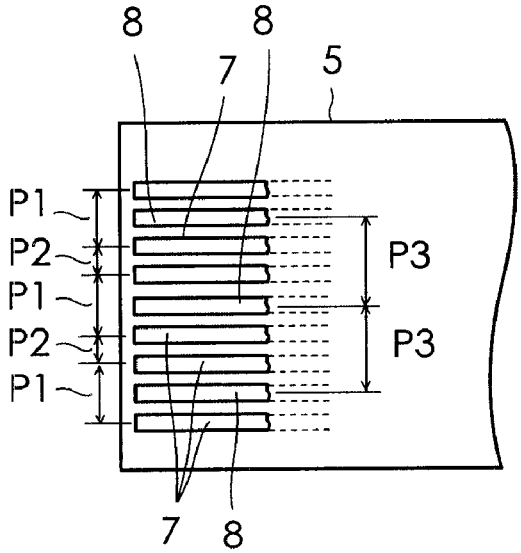

FIGS. 9A and 9B are perspective views of a third type of rectangular parallelepiped connecting element having an electrical component that is used in a connector device for interconnecting circuit substrates according to a fifth embodiment of the present invention in which an ESD (electrostatic discharge) protection device is built in, as viewed from a front side and a rear side. FIGS. 10A and 10B are partial plan views of first and second circuit substrates to be connected to each other using the connector device for interconnecting circuit substrates of the fifth embodiment. In the fifth embodiment (FIGS. 9 and 10), portions similar to those of the first to fourth embodiments (FIGS. 1 to 8) have their reference numerals same as the corresponding reference numerals used in the first to fourth embodiments (FIGS. 1 to 8), and their descriptions will partially be omitted. A first circuit substrate 1 to be connected using a connector device for interconnecting circuit substrates, in which the third type of rectangular parallelepiped connecting element having an electrical component 9 is received in the connector housing 11 of FIG. 4, includes a plurality of first connecting electrodes 3 juxtaposed on a surface thereof alternately at first and second pitches P1 and P2 for electrodes as shown in FIG. 10A. A second circuit substrate 5 includes a plurality of second connecting electrodes 7 juxtaposed on a surface thereof at the first and second pitches P1 and P2 for electrodes, and a plurality of third connecting electrodes 8 juxtaposed between the second connecting electrodes 7 disposed at the first pitch P1 for electrodes at a third pitch P3 for electrodes as shown in FIG. 10B.

The third type of rectangular parallelepiped connecting element having an electrical component 9 used in the connector device for interconnecting circuit substrates according to the present embodiment includes a rectangular parallelepiped insulating base 13 having four continuous faces 13*a* to 13*d* and two end faces 13*e* and 13*f*. The insulating base 13 includes a plurality of first electrically conducting paths 17*a* juxtaposed on at least three continuous faces 13*a* to 13*c* of the four continuous faces 13*a* to 13*d* of the insulating base 13 in a direction where the two end faces 13*e* and 13*f* are arranged at a given insulating interval so that a first pitch P1 for electrically conducting paths equal to the first pitch P1 for electrodes and a second pitch P2 for electrically conducting paths equal to the second pitch P2 for electrodes may alternately appear. The insulating base 13 further includes a plurality of second electrically conducting paths 17*b* juxtaposed at a given insulating interval 15 on three continuous faces 13*b* to 13*d* including two continuous faces 13*b* and 13*c* of the three continuous faces 13*a* to 13*c* in the direction where the two end faces 13*e* and 13*f* are arranged. Each second electrically conducting path 17*b* is disposed at a third pitch P3 for electrically conducting paths equal to the third pitch for electrodes between two of the first electrically conducting paths 17*a* disposed at the first pitch for electrically conducting paths P1. Electric elements 19 are formed on one face 13*b* located between two opposed faces 13*a* and 13*c* of the three continuous faces 13*a* to 13*c*, and disposed across two first electrically conducting path portions 17*a* disposed at the first pitch P1 for electrically conducting paths and a second electrically conducting path portion 17*b* located between the two first electrically conducting path portions 17*a*. The two first electrically conducting path portions are included in the two first electrically conducting paths, and the second electrically conducting path portion is included in the second electrically conducting path. The electric element 19 is made of an ESD absorption element material. In this configuration, the second electrically conducting paths 17*b* are grounded, and electrostatic discharge is generated between the first electrically conducting path portions 17*a* and the second electrically conducting path portion 17*b*.

Figure 11A:
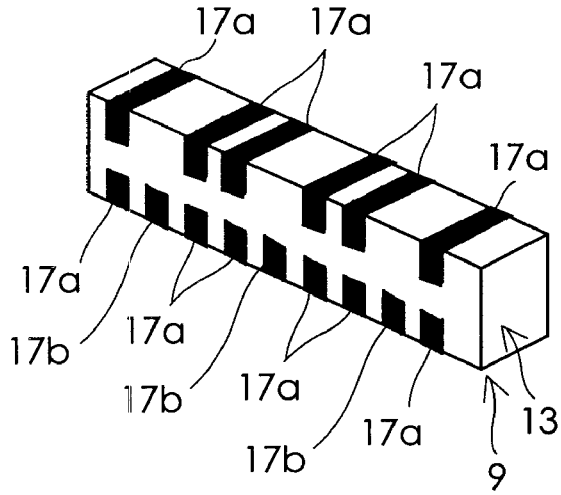
FIGS. 11A and 11B are perspective views of a fourth type of rectangular parallelepiped connecting element having an electrical component that is used in a connector device for interconnecting circuit substrates according to a sixth embodiment of the present invention, as viewed from a front side and a rear side respectively.
Figure 11B:
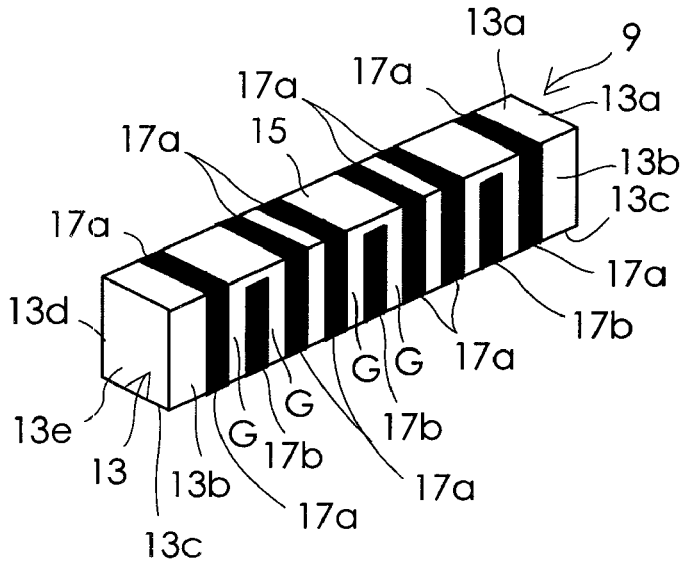

FIGS. 11A and 11B are perspective views of a fourth type of rectangular parallelepiped connecting element having an electrical component that is used in a connector device for interconnecting circuit substrates according to a sixth embodiment of the present invention, as viewed from a front side and a rear side respectively The rectangular parallelepiped connecting element having an electrical component 9 of FIG. 11 is a fourth type of rectangular parallelepiped connecting element having an electrical component 9 that is used when an ESD (electrostatic discharge) protection device is built in the connector device for interconnecting circuit substrates as with the third type of rectangular parallelepiped connecting element 9 having an electrical component 9 used in the connector device for interconnecting circuit substrates of the fifth embodiment in FIG. 9. In the sixth embodiment (FIG. 11), portions similar to those of the first to fifth embodiments (FIGS. 2 to 10) have their reference numerals same as the corresponding reference numerals used in the first to fifth embodiments (FIGS. 2 to 10), and their descriptions will partially be omitted. The fourth type of rectangular parallelepiped connecting element having an electrical component 9 of FIG. 11 is configured similar to the third type of rectangular parallelepiped connecting element having an electrical component 9 of FIGS. 9A and 9B except that no electric element 19 made of an ESD absorbing element material is disposed thereon. The fourth type of rectangular parallelepiped connecting element having an electrical component 9 is configured to have a gap G for discharge on a face 13*b* of an insulating base 13 between a second electrically conducting path 17*b* and a first electrically conducting path 17*a* disposed on both sides of the second electrically conducting path 17*b*. Accordingly, when the fourth type of rectangular parallelepiped connecting element having electrical component 9 is used, electrostatic discharge is generated directly in the gap for discharge G between the first and second electrically conducting path portions 17*a* and 17*b*.

When the third or fourth type of rectangular parallelepiped connecting element having an electrical component 9 is used, the connector housing 11 of FIG. 4 is mounted to the first circuit substrate 1 with the rectangular parallelepiped connecting element 9 received therein when the connector housing is mounted to the first circuit substrate 1 of FIG. 10. The connector housing 11 may be configured to allow the plurality of first electrically conducting path portions 17*a* disposed on one face 13*a* of the two opposed faces 13*a* and 13*c* in the three continuous faces 13*a* to 13*c* of the rectangular parallelepiped connecting element 9 to be electrically connected to the plurality of first connecting electrodes 3 disposed on the first circuit substrate 1. The connector housing 11 may also be configured to receive a substrate portion of the second circuit substrate 5 where the plurality of second connecting electrodes 7 are disposed and hold the substrate portion in a position where the plurality of first electrically conducting path portions 17*a* disposed on the other face 13*c* of the two opposed faces 13*a* and 13*c* in the three continuous faces 13*a* to 13*c* of the rectangular parallelepiped connecting element 9 are opposed to the plurality of second connecting electrodes 7 disposed on the second circuit substrate 5, and the plurality of second electrically conducting path portions 17*b* disposed on the other face 13*c* are opposed to the plurality of third connecting electrodes 8 disposed on the second circuit substrate 5. Then, the connector housing 11 may be configured to bring the plurality of second connecting electrodes 7 into contact with the plurality of first electrically conducting path portions 17*a* and bring the plurality of third connecting electrodes 8 into contact with the plurality of second electrically conducting path portions 17*b*. In this configuration, the third connecting electrodes are grounded.

When the connector housing 11 is mounted to the second circuit substrate 5, the connector housing 11 is configured to allow the plurality of first electrically conducting path portions 17*a* disposed on the one face 13*a* of the two opposed faces 13*a* and 13*c* in the three continuous faces 13*a* to 13*c* of the rectangular parallelepiped connecting element 9 to be electrically connected to the plurality of second connecting electrodes 7 disposed on the second circuit substrate 5 and allow the plurality of second conducting path portions 17*b* to be electrically connected to the plurality of third connecting electrodes 8 disposed on the second circuit substrate 5. The connector housing 11 is also configured to receive a substrate portion of the first circuit substrate 1 where the plurality of first connecting electrodes 3 are disposed and hold the substrate portion in a position where the plurality of first electrically conducting path portions 17*a* disposed on the other face 13*c* of the two opposed faces 13*a* and 13*c* among the three continuous faces 13*a* to 13*c* of the rectangular parallelepiped connecting element 9 are opposed to the plurality of first connecting electrodes 3 disposed on the first circuit substrate 1. Further, the connector housing 11 is configured to bring the plurality of first connecting electrodes 3 into contact with the plurality of first electrically conducting path portions 17*a*. Even in this configuration, the third connecting electrodes are grounded.

INDUSTRIAL APPLICABILITY

In a connector device for interconnecting circuit substrates according to the present invention, it is possible to electrically interconnect two circuit substrates by inserting one of the two circuit substrates into a connector housing. According to the present invention, since connector device may be constituted just by disposing a rectangular parallelepiped connecting element having an electrical component in the connector housing without disposing a plurality of contact components, the connector device may be constituted simply from a few number of components. In particular, according to the present invention, since electric elements are disposed on the rectangular parallelepiped connecting element used for connecting two circuit substrates to each other, it becomes possible to connect an electric element for protection between connecting electrodes on two circuit substrates to be interconnected, merely by mounting the connector device for interconnecting circuit substrates on one of the two circuit substrates. As a result, the connector device for interconnecting circuit substrates of the present invention has eliminated the need to separately mount an electric element for protection on the circuit substrates.

The invention claimed is:

1. A connector device for interconnecting circuit substrates that is used for electrically connecting a plurality of first connecting electrodes disposed on a first circuit substrate and a plurality of second connecting electrodes disposed on a second circuit substrate, the plurality of first connecting electrodes being juxtaposed on a surface of the first circuit substrate at a first pitch for electrodes, the plurality of second connecting electrodes being juxtaposed on a surface of the second circuit substrate at a second pitch for electrodes, the connector device for interconnecting circuit substrates comprising:

a rectangular parallelepiped connecting element having an electrical component including:

a rectangular parallelepiped insulating base having four continuous faces and two opposed end faces;

a plurality of first electrically conducting path portions that are juxtaposed on one of two opposed faces in at least three continuous faces among the four continuous faces of the insulating base at a given insulating interval in a direction where the two opposed end faces are arranged;

a plurality of second electrically conducting path portions that are juxtaposed on the other one of the two opposed faces in the three continuous faces of the insulating base at a given insulating interval in a direction where the two opposed end faces are arranged; and a plurality of electric elements that are juxtaposed on one face located between the two opposed faces in the three continuous faces at a given insulating interval in the direction where the two opposed end faces are arranged;

the plurality of electric elements being connected in series with the plurality of first electrically conducting path portions and the plurality of second electrically conducting path portions, wherein a pitch for electrically conducting paths of the plurality of first electrically conducting path portions is substantially equal to the first pitch for electrodes, and a pitch for electrically conducting paths of the plurality of second electrically conducting path portions is substantially equal to the second pitch for electrodes; and a connector housing mounted to the first circuit substrate with the rectangular parallelepiped connecting element having an electrical component being received therein, wherein the connector housing is configured to:

allow the plurality of first electrically conducting path portions disposed on the rectangular parallelepiped connecting element having electrical components to be electrically connected to the plurality of first connecting electrodes disposed on the first circuit substrate;

receive a substrate portion of the second circuit substrate where the plurality of second connecting electrodes are disposed and hold the substrate portion in a position where the plurality of second electrically conducting path portions disposed on the rectangular parallelepiped connecting element having an electrical component are opposed to the plurality of second connecting electrodes; and bring the plurality of second connecting electrodes into contact with the plurality of second electrically conducting path portions.

2. The connector device for interconnecting circuit substrates according to claim 1, wherein a plurality of first electrode portions connected to the plurality of first electrically conducting path portions and a plurality of second electrode portions connected to the plurality of second electrically conducting path portions are formed on the one face where the electric elements are formed, the electric element being formed across the first electrode portion and the second electrode portion.

3. The connector device for interconnecting circuit substrates according to claim 1, wherein the pitch for electrically conducting paths of the plurality of first electrically conducting path portions is equal to that of the plurality of second electrically conducting path portions, and the plurality of first electrically conducting path portions and the plurality of second electrically conducting path portions are disposed alternately in the direction where the two end faces are arranged.

4. The connector device for interconnecting circuit substrates according to claim 1, wherein the pitch for electrically conducting paths of the plurality of first electrically conducting path portions is different from that of the plurality of second electrically conducting path portions.

5. The connector device for interconnecting circuit substrates according to claim 1, wherein the connector housing comprises:

a housing body including:

a first receiving chamber which receives the connecting element with the one face of the connecting element exposed;

a second receiving chamber that communicates with the first receiving chamber and receives the substrate portion; and an inserting opening through which the substrate portion is inserted into the second receiving chamber from outside; and a pushing means that is received in the second receiving chamber and pushes the substrate portion against the connecting element.

6. A connector device for interconnecting circuit substrates according to claim 1, wherein the connector housing comprises:

a housing body includes:

a first receiving chamber which receives the connecting element with the one face of the connecting element exposed, a second receiving chamber that communicates with the first receiving chamber and receives the substrate portion, an inserting opening through which the substrate portion is inserted into the second receiving chamber from outside; and a pushing means that is received in the second receiving chamber and pushes the substrate portion against the connecting element;

the pushing means being configured to push the substrate portion against the connecting element by means of spring force or elastic force.

7. A connector device for interconnecting circuit substrates that is used for electrically connecting a plurality of first connecting electrodes disposed on a first circuit substrate and a plurality of second connecting electrodes disposed on a second circuit substrate, the plurality of first connecting electrodes being juxtaposed on a surface of the first circuit substrate at a first pitch for electrodes, the plurality of second connecting electrodes being juxtaposed on a surface of the second circuit substrate at a second pitch for electrodes, the connector device for interconnecting circuit substrates comprising:

a rectangular parallelepiped connecting element having an electrical component including:

a rectangular parallelepiped insulating base having four continuous faces and two opposed end faces;

a plurality of first electrically conducting path portions that are juxtaposed on one of two opposed faces in the four continuous faces of the insulating base at a given insulating interval in a direction where the two opposed end faces are arranged;

a plurality of second electrically conducting path portions that are juxtaposed on the other one of the two opposed faces among the four continuous faces at a given insulating interval in a direction where the two opposed end faces are arranged;

a first group of a plurality of electric elements that are juxtaposed on one face among two faces located between the two opposed faces of the four continuous faces at a given insulating interval in the direction where the two end faces are arranged; and a second group of a plurality of electric elements that are juxtaposed on the other face among the two faces located between the two opposed faces of the four continuous faces at a given insulating interval in the direction where the two opposed end faces are arranged;

the plurality of electric elements belonging to the first and second groups being electrically connected in series to the corresponding first electrically conducting path portions and the corresponding second electrically conducting path portions, wherein a pitch for electrically conducting paths of the plurality of first electrically conducting path portions is substantially equal to the first pitch for electrodes, and a pitch for electrically conducting paths of the plurality of second electrically conducting path portions is substantially equal to the second pitch for electrodes; and a connector housing mounted to the first circuit substrate with the rectangular parallelepiped connecting element having an electrical component being received therein, wherein the connector housing is configured to:

allow the plurality of first electrically conducting path portions disposed on the rectangular parallelepiped connecting element having an electrical component to be electrically connected to the plurality of first connecting electrodes disposed on the first circuit substrate;

receive a substrate portion of the second circuit substrate where the plurality of second connecting electrodes are disposed and hold the substrate portion in a position where the plurality of second electrically conducting path portions disposed on the rectangular parallelepiped connecting element having an electrical component are opposed to the plurality of second connecting electrodes; and bring the plurality of second connecting electrodes into contact with the plurality of second electrically conducting path portions.

8. The connector device for interconnecting circuit substrates according to claim 7, wherein a plurality of first electrode portions connected to the plurality of first electrically conducting path portions and a plurality of second electrode portions connected to the plurality of second electrically conducting path portions are formed on the one face where the first group of the plurality of electric elements are formed, the first group of the electric elements being formed across the first electrode portions and the second electrode portions, and a plurality of third electrode portions connected to the plurality of first electrically conducting path portions, and a plurality of fourth electrode portions connected to the plurality of second electrically conducting path portions are formed on the other face where the second group of the plurality of electric elements are formed, the second group of the electric elements being formed across the third electrode portions and the fourth electrode portions.

9. The connector device for interconnecting circuit substrates according to claim 7, wherein the first group of the plurality of electric elements and the second group of the plurality of electric elements have different electrical characteristics or are of different kinds of electric element.

10. The connector device for interconnecting circuit substrates according to claim 7, wherein the pitch for electrically conducting paths of the plurality of first electrically conducting path portions is equal to that of the plurality of second electrically conducting path portions, and the plurality of first electrically conducting path portions and the plurality of second electrically conducting path portions are disposed alternately in the direction where the two end faces are arranged.

11. The connector device for interconnecting circuit substrates according to claim 7, wherein the pitch for electrically conducting paths of the plurality of first electrically conducting path portions is different from that of the plurality of second electrically conducting path portions.

12. The connector device for interconnecting circuit substrates according to claim 7, wherein the connector housing comprises:

a housing body including:

a first receiving chamber which receives the connecting element with the one face of the connecting element exposed, a second receiving chamber that communicates with the first receiving chamber and receives the substrate portion, and an inserting opening through which the substrate portion is inserted into the second receiving chamber from outside; and a pushing means that is received in the second receiving chamber and pushes the substrate portion against the connecting element.

13. The connector device for interconnecting circuit substrates according to claim 7, wherein the connector housing comprises:

a housing body including:

a first receiving chamber which receives the connecting element with the one face of the connecting element exposed, a second receiving chamber that communicates with the first receiving chamber and receives the substrate portion, and an inserting opening through which the substrate portion is inserted into the second receiving chamber from outside; and a pushing means that is received in the second receiving chamber and pushes the substrate portion against the connecting element;

the pushing means being configured to push the substrate portion against the connecting element by means of spring force or elastic force.

14. A connector device for interconnecting circuit substrates that is used for electrically connecting a plurality of first connecting electrodes disposed on a surface of a first circuit substrate and a plurality of second connecting electrodes disposed on a surface of a second circuit substrate, the plurality of first connecting electrodes being juxtaposed alternately at first and second pitches for electrodes, the plurality of second connecting electrodes being juxtaposed alternately at the first and second pitches for electrodes, and a plurality of third connecting electrodes being juxtaposed at a third pitch for electrodes, each third connecting electrode being disposed between two of the second connecting electrodes disposed at the first pitch for electrodes on the second circuit substrate, the connector device for interconnecting circuit substrates comprising:

a rectangular parallelepiped connecting element having an electrical component including:

a rectangular parallelepiped insulating base having four continuous faces and two opposed end faces;

a plurality of first electrically conducting paths juxtaposed on at least three continuous faces in the four continuous faces of the insulating base in a direction where the two end faces are arranged at a given insulating interval so that a first pitch for electrically conducting paths equal to the first pitch for electrodes and a second pitch for electrically conducting paths equal to the second pitch for electrodes may alternately appear;

a plurality of second electrically conducting paths juxtaposed at a given insulating interval on two continuous faces in the three continuous faces in the direction where the two end faces are arranged, each second electrically conducting path being disposed at a third pitch for electrically conducting paths equal to the third pitch for electrodes between two of the first electrically conducting paths disposed at the first pitch for electrically conducting paths; and a plurality of electric elements made of an ESD absorbing element material, which are disposed on one face located between the two opposed faces of the three continuous faces, and disposed across two first electrically conducting path portions and a second electrically conducting path portion located between the two first electrically conducting path portions, the two first electrically conducting path portions being included in two of the first electrically conducting paths disposed at the first pitch for electrically conducting paths and the second electrically conducting path portion included in the second electrically conducting path; and a connector housing mounted to the first circuit substrate with the rectangular parallelepiped connecting element having an electrical component being received therein, wherein the connector housing is configured to:

allow the plurality of first electrically conducting path portions disposed on one of the two opposed faces of the three continuous faces of the rectangular parallelepiped connecting element having an electrical component to be electrically connected to the plurality of first connecting electrodes disposed on the first circuit substrate;

receive a substrate portion of the second circuit substrate where the plurality of second connecting electrodes are disposed and hold the substrate portion in a position where the plurality of first electrically conducting path portions disposed on the other one of the two opposed faces of the three continuous faces of the rectangular parallelepiped connecting element having an electrical component are opposed to the plurality of second connecting electrodes disposed on the second circuit substrate and the plurality of second electrically conducting path portions disposed on the other face are opposed to the plurality of third connecting electrodes disposed on the second circuit substrate; and bring the plurality of second connecting electrodes into contact with the first electrically conducting path portions and also bring the plurality of third connecting electrodes into contact with the second electrically conducting path portions.

15. A connector device for interconnecting circuit substrates that is used for electrically connecting a plurality of first connecting electrodes disposed on a surface of a first circuit substrate and a plurality of second connecting electrodes disposed on a surface of a second circuit substrate, the plurality of first connecting electrodes being juxtaposed alternately at first and second pitches for electrodes, the plurality of second connecting electrodes being juxtaposed alternately at the first and second pitches for electrodes and a plurality of third connecting electrodes being juxtaposed at a third pitch for electrodes on the second circuit substrate, each third connecting electrode being disposed between two of the second connecting electrodes disposed at the first pitch for electrodes, the connector device for interconnecting circuit substrates comprising:

a rectangular parallelepiped connecting element having an electrical component including a rectangular parallelepiped insulating base having four continuous faces and two opposed end faces;

a plurality of first electrically conducting paths juxtaposed on at least three continuous faces of the four continuous faces of the insulating base in a direction where the two end faces are arranged at a given insulating interval so that a first pitch for electrically conducting paths equal to the first pitch for electrodes and a second pitch for electrically conducting paths equal to the second pitch for electrodes may alternately appear;

a plurality of second electrically conducting paths juxtaposed at a given insulating interval on two continuous faces of the three continuous faces in a direction where the two end faces are arranged, each second electrically conducting path being disposed at a third pitch for electrically conducting paths equal to the third pitch for electrodes between two of the first electrically conducting paths disposed at the first pitch for electrically conducting paths; and a plurality of electric element made of an ESD absorbing element material, which are disposed on one face located between the two opposed faces of the three continuous faces, disposed across the two first electrically conducting path portions and a second electrically conducting path portion located between the two first electrically conducting path portions, the two first electrically conducting path portions being included in two of the first electrically conducting paths disposed at the first pitch for electrically conducting paths and the second electrically conducting path portion included in the second electrically conducting path; and a connector housing mounted to the first circuit substrate with the rectangular parallelepiped connecting element having an electrical component being received therein, wherein the connector housing is configured to:

allow the plurality of first electrically conducting path portions disposed on one of the two opposed faces of the three continuous faces of the rectangular parallelepiped connecting element having an electrical component to be electrically connected to the plurality of second connecting electrodes disposed on the second circuit substrate and also allow the plurality of second conducting path portions to be electrically connected to the plurality of third connecting electrodes disposed on the second circuit substrate;

receive a substrate portion of the first circuit substrate where the plurality of first connecting electrodes are disposed and hold the substrate portion in a position where the plurality of first electrically conducting path portions disposed on the other one of the two opposed faces of the three continuous faces of the rectangular parallelepiped connecting element having an electrical component are opposed to the plurality of first connecting electrodes disposed on the first circuit substrate; and bring the plurality of first connecting electrodes into contact with the plurality of first electrically conducting path portions.

16. A connector device for interconnecting circuit substrates that is used for electrically connecting a plurality of first connecting electrodes disposed on a surface of a first circuit substrate and a plurality of second connecting electrodes disposed on a surface of a second circuit substrate, the plurality of first connecting electrodes being juxtaposed alternately at first and second pitches for electrodes, the plurality of second connecting electrodes being juxtaposed alternately at the first and second pitches for electrodes, and a plurality of third connecting electrodes being juxtaposed at a third pitch for electrodes on the second circuit substrate, each third connecting electrodes being disposed between two of the second connecting electrodes disposed at the first pitches for electrodes, the connector device for interconnecting circuit substrates comprising:

a rectangular parallelepiped connecting element having an electrical component including:

a rectangular parallelepiped insulating base having four continuous faces and two opposed end faces;

a plurality of first electrically conducting paths juxtaposed on at least three continuous faces of the four continuous faces of the insulating base in a direction where the two end faces are arranged at a given insulating interval so that a first pitch for electrically conducting paths equal to the first pitch for electrodes and a second pitch for electrically conducting paths equal to the second pitch for electrodes may alternately appear;

a plurality of second electrically conducting paths juxtaposed at a given insulating interval on two continuous faces of the three continuous faces in a direction where the two end faces are arranged, each second electrically conducting path being disposed at a third pitch for electrically conducting paths equal to the third pitch for electrodes between two of the first electrically conducting paths disposed at the first pitch for electrically conducting paths; and a connector housing mounted to the first circuit substrate with the rectangular parallelepiped connecting element being received therein, wherein the connector housing is configured to:

allow a plurality of first electrically conducting path portions of the plurality of first electrically paths disposed on one of the two opposed faces of the three continuous faces of the rectangular parallelepiped connecting element to be electrically connected to the plurality of first connecting electrodes disposed on the first circuit substrate;

receive a substrate portion of the second circuit substrate where the plurality of second connecting electrodes are disposed and hold the substrate portion in a position where the plurality of first electrically conducting path portions disposed on the other one of the two opposed faces of the three continuous faces of the rectangular parallelepiped connecting element are opposed to the plurality of second connecting electrodes disposed on the second circuit substrate and a plurality of second electrically conducting path portions of the plurality of second electrically conducting paths disposed on the other face are opposed to the plurality of third connecting electrodes disposed on the second circuit substrate; and bring the plurality of second connecting electrodes into contact with the first electrically conducting path portions and also bring the plurality of third connecting electrodes into contact with the second electrically conducting path portions.

17. A connector device for interconnecting circuit substrates that is used for electrically connecting a plurality of first connecting electrodes disposed on a surface of a first circuit substrate and a plurality of second connecting electrodes disposed on a surface of a second circuit substrate, the plurality of first connecting electrodes being juxtaposed alternately at first and second pitches for electrodes, the plurality of second connecting electrodes being juxtaposed alternately at the first and second pitches for electrodes, and a plurality of third connecting electrodes being juxtaposed at a third pitch for electrodes on the second circuit substrate, each third connecting electrode being disposed between two of the second connecting electrodes disposed at the first pitches for electrodes, the connector device for interconnecting circuit substrates comprising:

a rectangular parallelepiped connecting element having electrical component including:

a rectangular parallelepiped insulating base having four continuous faces and two opposed end faces;

a plurality of first electrically conducting paths juxtaposed on at least three continuous faces of the four continuous faces of the insulating base in a direction where the two end faces are arranged at a given insulating interval so that a first pitch for electrically conducting paths equal to the first pitch for electrodes and a second pitch for electrically conducting paths equal to the second pitch for electrodes may alternately appear;

a plurality of second electrically conducting paths juxtaposed at a given insulating interval on two continuous faces of the three continuous faces in a direction where the two end faces are arranged, each second electrically conducting path being disposed at a third pitch for electrically conducting paths equal to the third pitch for electrodes between two of the first electrically conducting paths disposed at the first pitch for electrically conducting paths; and a connector housing mounted to the first circuit substrate with the rectangular parallelepiped connecting element being received therein, wherein the connector housing is configured to:

allow a plurality of first electrically conducting path portions of the plurality of first electrically conducting paths disposed on one of the two opposed faces of the three continuous faces of the rectangular parallelepiped connecting element to be electrically connected to the plurality of second connecting electrodes disposed on the second circuit substrate and also allow a plurality of second conducting path portions of the plurality of second conducting paths to be electrically connected to the plurality of third connecting electrodes disposed on the second circuit substrate;

receive a substrate portion of the first circuit substrate where the plurality of first connecting electrodes are disposed and hold the substrate portion in a position where the plurality of first electrically conducting path portions disposed on the other one of the two opposed faces of the three continuous faces of the rectangular parallelepiped connecting element are opposed to the plurality of first connecting electrodes disposed on the first circuit substrate; and bring the plurality of first connecting electrodes into contact with the plurality of first electrically conducting path portions.

18. The connector device for interconnecting circuit substrates according to claim 14, wherein the connector housing comprises:

a housing body including:

a first receiving chamber which receives the connecting element with one face of the connecting element exposed; a second receiving chamber that communicates with the first receiving chamber and receives the substrate portion; and an inserting opening through which the substrate portion is inserted into the second receiving chamber from outside; and a pushing means that is received in the second receiving chamber and pushes the substrate portion against the connecting element.

19. A connector device for interconnecting circuit substrates according to claim 14, wherein the connector housing comprises:

a housing body including:

a first receiving chamber which receives the connecting element with one face of the connecting element exposed;

a second receiving chamber that communicates with the first receiving chamber and receives the substrate portion; and an inserting opening through which the substrate portion is inserted into the second receiving chamber from outside; and a pushing means that is received in the second receiving chamber and pushes the substrate portion against the connecting element;

the pushing means being configured to push the substrate portion against the connecting element by means of spring force or elastic force.

* * * * *